US012221865B2

(12) United States Patent
Kash et al.

(10) Patent No.: US 12,221,865 B2
(45) Date of Patent: Feb. 11, 2025

(54) FRANGIBLE ELECTRICAL CONTACT FOR A PERFORATING GUN SYSTEM

(71) Applicant: G&H Diversified Manufacturing LP, Houston, TX (US)

(72) Inventors: Danny Kash, Houston, TX (US); Jimmy Kash, Houston, TX (US); Benjamin Knight, Katy, TX (US); Ryan Ward, Tomball, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 81 days.

(21) Appl. No.: 17/982,206

(22) Filed: Nov. 7, 2022

(65) Prior Publication Data

US 2023/0142907 A1 May 11, 2023

Related U.S. Application Data

(60) Provisional application No. 63/277,414, filed on Nov. 9, 2021.

(51) Int. Cl.
*E21B 43/1185* (2006.01)
*E21B 43/117* (2006.01)
*E21B 43/119* (2006.01)

(52) U.S. Cl.
CPC ..... *E21B 43/1185* (2013.01); *E21B 43/117* (2013.01); *E21B 43/119* (2013.01)

(58) Field of Classification Search
CPC .... E21B 43/1185; E21B 43/116; E21B 43/11; E21B 43/117; E21B 43/119; E21B 43/1193; F42D 1/043
See application file for complete search history.

(56) References Cited

U.S. PATENT DOCUMENTS 4,737,114 A * 4/1988 Yaegashi ..... H01R 12/585 439/82
2016/0215597 A1* 7/2016 LaGrange ..... E21B 43/11852
2019/0257181 A1* 8/2019 Langford ..... E21B 43/1185
2019/0309609 A1* 10/2019 Hardesty ..... E21B 43/1185
2020/0256166 A1* 8/2020 Knight ..... E21B 23/065
(Continued)

FOREIGN PATENT DOCUMENTS

CA 3074637 A1 * 9/2020 ..... E21B 43/117

*Primary Examiner* — Daniel P Stephenson
(74) *Attorney, Agent, or Firm* — Conley Rose, P.C.

(57) ABSTRACT

A perforating gun deployable in a wellbore includes an outer housing included of a generally tubular wall structure having a pair of opposed longitudinal ends and a central passage extending between the pair of longitudinal ends, a charge carrier assembly received in the central passage of the outer housing and including a tubular charge carrier having a pair of opposed longitudinal ends and at least one radially oriented receptacle configured to receive a combustive shaped charge, an initiator assembly, the initiator assembly including a detonator and an electrical switch configured to detonate the detonator in response to receiving a firing signal, and an electrical connector positioned in the central passage of the outer housing and electrically connected to the initiator assembly, the electrical connector including an electrical contact including a frangible conductor rod, the frangible conductor rod having a shear strength of 1,500 pound-force (lbf) or less.

28 Claims, 4 Drawing Sheets

(56) References Cited

U.S. PATENT DOCUMENTS

| | | | | |
|---|---|---|---|---|
| 2020/0256168 | A1* | 8/2020 | Knight | E21B 43/119 |
| 2021/0180434 | A1* | 6/2021 | Knight | E21B 43/117 |
| 2021/0207934 | A1* | 7/2021 | Sullivan | E21B 43/1185 |
| 2022/0018227 | A1* | 1/2022 | Kash | E21B 43/117 |
| 2022/0163298 | A1* | 5/2022 | Kash | E21B 43/1185 |
| 2022/0282600 | A1* | 9/2022 | Dyess | E21B 43/117 |
| 2023/0142907 | A1* | 5/2023 | Kash | E21B 43/1185<br>166/297 |
| 2023/0366299 | A1* | 11/2023 | Badii | E21B 43/1185 |

* cited by examiner

FRANGIBLE ELECTRICAL CONTACT FOR A PERFORATING GUN SYSTEM

CROSS-REFERENCE TO RELATED APPLICATIONS

This application claims benefit of U.S. provisional patent application Ser. No. 63/277,414 filed Nov. 9, 2021, and entitled "Frangible Electrical Contact for a Perforating Gun System," which is hereby incorporated herein by reference in its entirety for all purposes.

STATEMENT REGARDING FEDERALLY SPONSORED RESEARCH OR DEVELOPMENT

Not applicable.

BACKGROUND

Hydrocarbons may be produced by drilling a wellbore into a subterranean earthen formation to provide fluid conductivity between the wellbore and a subterranean hydrocarbon bearing reservoir contained in the earthen formation. In some applications, the wellbore may be supported by a tubular casing string (also referred to simply as "casing") which extends from the surface to a bottom or toe of the wellbore. Cement is typically pumped into the annular interface formed between a sidewall of the wellbore and an exterior of the casing string to secure and seal the casing string to the sidewall of the wellbore. In this arrangement, the casing string is then perforated at one or more desired locations within the wellbore. For example, the casing string may be perforated at a plurality of separate locations to provide fluid communication between the target hydrocarbon production zone and a central passage of the casing string.

Typically, the casing string is perforated by a perforating gun system including a tool string that is deployed along a wireline suspended from the surface. The tool string of the perforating gun system includes one or more perforating guns each including explosive charges but include other components such as to orient the explosive charges of the perforating guns and to control the detonation those charges. Often, one of the components for controlling the detonation is an electrical contact positioned at either end of the given perforating gun of the perforating gun system to make electrical contact with other components of the tool string. When the charges of the perforating gun are detonated, an intense pressure pulse and consequential violence and vibration is generated within each perforating gun which typically damages or destroys much of the internal components of the detonated perforating gun. Those damaged and destroyed components are further knocked around within the perforating gun by subsequent blasts of other perforating guns of the tool string.

In rare instances, the explosive forces generated by the detonation of the explosive charges of a perforating gun have dislodged an electrical connector of the perforating gun such that the connector projects partly into the annulus between the exterior of the perforating gun and the inside of the casing resulting in the tool string becoming jammed or caught within the casing string in which the tool string is positioned. It may be understood that having a tool string stuck in a wellbore is a potentially big, expensive, and embarrassing problem. Particularly, the maximum tension that the wireline may apply to the tool string to retract it from the wellbore is generally limited by the rated strength of the wireline cable. In such a scenario with a tool string stuck within a wellbore, the wireline operator has the means to release the wireline cable from the tool string when the tool string cannot be dislodged by recurring pushes and pulls by the cable along with intermittent applications of hydraulic pressure within the wellbore. Once the wireline operator has released from the tool string, a specialized rig is typically called to the wellsite to fish out the stuck tool string. These specialized fishing rigs are often expensive and the resulting downtime at the wellsite waiting for the wellbore to become accessible again can add significant expense to the plug-and-perf operation.

Increased reliability of tool strings and perforating guns and reduced risks for getting stuck in wellbores will always be valued in the industry.

SUMMARY

An embodiment of a perforating gun deployable in a wellbore as part of a tool string comprises an outer housing comprised of a generally tubular wall structure having a pair of opposed longitudinal ends and a central passage extending between the pair of longitudinal ends; a charge carrier assembly received in the central passage of the outer housing and comprising a tubular charge carrier having a pair of opposed longitudinal ends and at least one radially oriented receptacle configured to receive a combustive shaped charge; an initiator assembly, the initiator assembly including a detonator and an electrical switch configured to detonate the detonator in response to receiving a firing signal; and an electrical connector positioned in the central passage of the outer housing and electrically connected to the initiator assembly, the electrical connector comprising an electrical contact including a frangible conductor rod, the frangible conductor rod having a shear strength of 1,500 pound-force (lbf) or less. In some embodiments, the shear strength of the frangible conductor rod is 750 lbf or less. In some embodiments, the shear strength of the frangible conductor rod is 300 lbf or less. In certain embodiments, the electrical contact comprises an electrically insulating overmolded body surrounding the frangible conductor rod. In certain embodiments, the overmolded body has an axial length which is more than half of the axial length of the frangible conductor rod. In some embodiments, the electrical connector comprises a biasing member and the overmolded body comprises an enlarged diameter annular flange contacted by the biasing member to bias the electrical contact. In some embodiments, the electrical contact further comprises a protective boot positioned around one of the longitudinal ends of the frangible conductor rod. In certain embodiments, the charge carrier assembly comprises a pair of endplates each comprising a central passage and coupled to the longitudinal ends of the tubular charge carrier, wherein the electrical connector is received in the central passage of each of the endplates. In some embodiments, the frangible conductor rod comprises a pair of opposed longitudinal ends, a peripheral surface extending between the pair of longitudinal ends, and the one or more frangible features in the form of one or more frangible grooves formed in the outer surface, wherein at least one of the one or more frangible grooves defines a minimum cross-sectional area of the frangible conductor rod. In certain embodiments, the frangible conductor rod comprises a pair of opposed longitudinal ends, an outer surface extending between the pair of longitudinal ends, and the one or more frangible features in the form of one or more frangible grooves formed in the outer surface and spaced along a majority of the axial length of the frangible conductor rod.

An embodiment of a perforating gun deployable in a wellbore as part of a tool string comprises an outer housing comprised of a generally tubular wall structure having a pair of opposed longitudinal ends and a central passage extending between the pair of longitudinal ends; a charge carrier assembly received in the central passage of the outer housing and comprising a tubular charge carrier having a pair of opposed longitudinal ends and at least one radially oriented receptacle configured to receive a combustive shaped charge; an initiator assembly, the initiator assembly including a detonator and an electrical switch configured to detonate the detonator in response to receiving a firing signal; and an electrical connector receivable in the central passage of the outer housing and electrically connected to the initiator assembly, the electrical connector comprising a frangible conductor rod comprising an elongated body with a pair of opposed longitudinal ends, a peripheral surface extending between the pair of longitudinal ends, and one or more frangible grooves formed in the peripheral surface, wherein at least one of the one or more frangible grooves defines a minimum cross-sectional area of the frangible conductor rod and a combined axial length of the one or more frangible grooves is at least 2% of the axial length of the frangible conductor rod. In some embodiments, the frangible conductor rod comprises a plurality of frangible grooves. In some embodiments, wherein the frangible conductor rod has a shear strength of 1,500 pound-force (lbf) or less. In certain embodiments, the conductor rod extends from the pair of longitudinal ends to a center of the frangible conductor rod, and at least one of the one or more frangible grooves is located on a first side of the frangible conductor rod extending from a first of the pair of longitudinal ends to the center of the frangible conductor rod, and at least one of the one or more frangible grooves is located on a second side of the frangible conductor rod extending from a second of the pair of longitudinal ends to the center of the frangible conductor rod. In certain embodiments, the electrical contact comprises an electrically insulating overmolded body surrounding the frangible conductor rod. In some embodiments, the electrical connector comprises a biasing member and the overmolded body comprises an annular flange contacted by the biasing member to bias the electrical contact. In some embodiments, the electrical contact further comprises a protective boot positioned around one of the longitudinal ends of the frangible conductor rod. In some embodiments, the charge carrier assembly comprises a pair of endplates each comprising a central passage and coupled to the longitudinal ends of the tubular charge carrier, wherein the electrical connector is received in the central passage of one of the pair of endplates.

An embodiment of a perforating gun deployable in a wellbore as part of a tool string comprises an outer housing comprised of a generally tubular wall structure having a pair of opposed longitudinal ends and a central passage extending between the pair of longitudinal ends; a charge carrier assembly received in the central passage of the outer housing and comprising a tubular charge carrier having a pair of opposed longitudinal ends and at least one radially oriented receptacle configured to receive a combustive shaped charge; an, the initiator assembly including a detonator and an electrical switch configured to detonate the detonator in response to receiving a firing signal; and an electrical connector receivable in the central passage of the outer housing and electrically connected to the initiator assembly, the electrical connector comprising a frangible conductor rod comprising an elongate body, a pair of opposed longitudinal ends, a peripheral surface extending between the pair of longitudinal ends, and a plurality of frangible grooves formed in the peripheral surface and spaced along a majority of the axial length of the frangible conductor rod. In some embodiments, the conductor rod extends from the pair of longitudinal ends to a center of the frangible conductor rod, and at least one of the plurality of frangible grooves is located on a first side of the frangible conductor rod extending from a first of the pair of longitudinal ends to the center of the frangible conductor rod, and at least one of the plurality of frangible grooves is located on a second side of the frangible conductor rod extending from a second of the pair of longitudinal ends to the center of the frangible conductor rod. In some embodiments, the electrical contact comprises an electrically insulating overmolded body surrounding the frangible conductor rod. In certain embodiments, the electrical connector comprises a biasing member and the overmolded body comprises an annular flange contacted by the biasing member to bias the electrical contact. In certain embodiments, the electrical contact further comprises a protective boot positioned around one of the longitudinal ends of the frangible conductor rod. In some embodiments, the charge carrier assembly comprises a pair of endplates each comprising a central passage and coupled to the longitudinal ends of the tubular charge carrier, wherein the electrical connector is received in the central passage of one of the pair of endplates.

An embodiment of a method of providing a perforating gun deployable in a wellbore as part of a tool string comprises (a) forming an electrical connector of the perforating gun comprising an electrical contact including a frangible conductor rod whereby the frangible conductor rod is configured to yield in response to an application of a shear load to the electrical contact that is equal to or greater than a predefined shear load, (b) coupling the electrical connector with an initiator assembly of the perforating gun that comprises an electrical switch, (c) coupling the electrical connector with a charge carrier of the perforating gun having at least one radially oriented receptacle configured to receive an explosive charge detonatable by the initiator assembly when ballistically coupled to the initiator assembly, and (d) positioning the charge carrier in a central passage of an outer housing of the perforating gun. In some embodiments, (a) comprises forming one or more voids along an outer surface of a conductor rod of the electrical contact to reduce the shear strength of the electrical contact. In certain embodiments, the predefined shear load is less than a maximum shear load imposable by a surface wireline unit connected to the tool string. In certain embodiments, the method further comprises (e) deploying the perforating gun down into the wellbore with the tool string attached to the wireline unit.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of exemplary embodiments of the disclosure, reference will now be made to the accompanying drawings in which.

DETAILED DESCRIPTION

Figure 1:
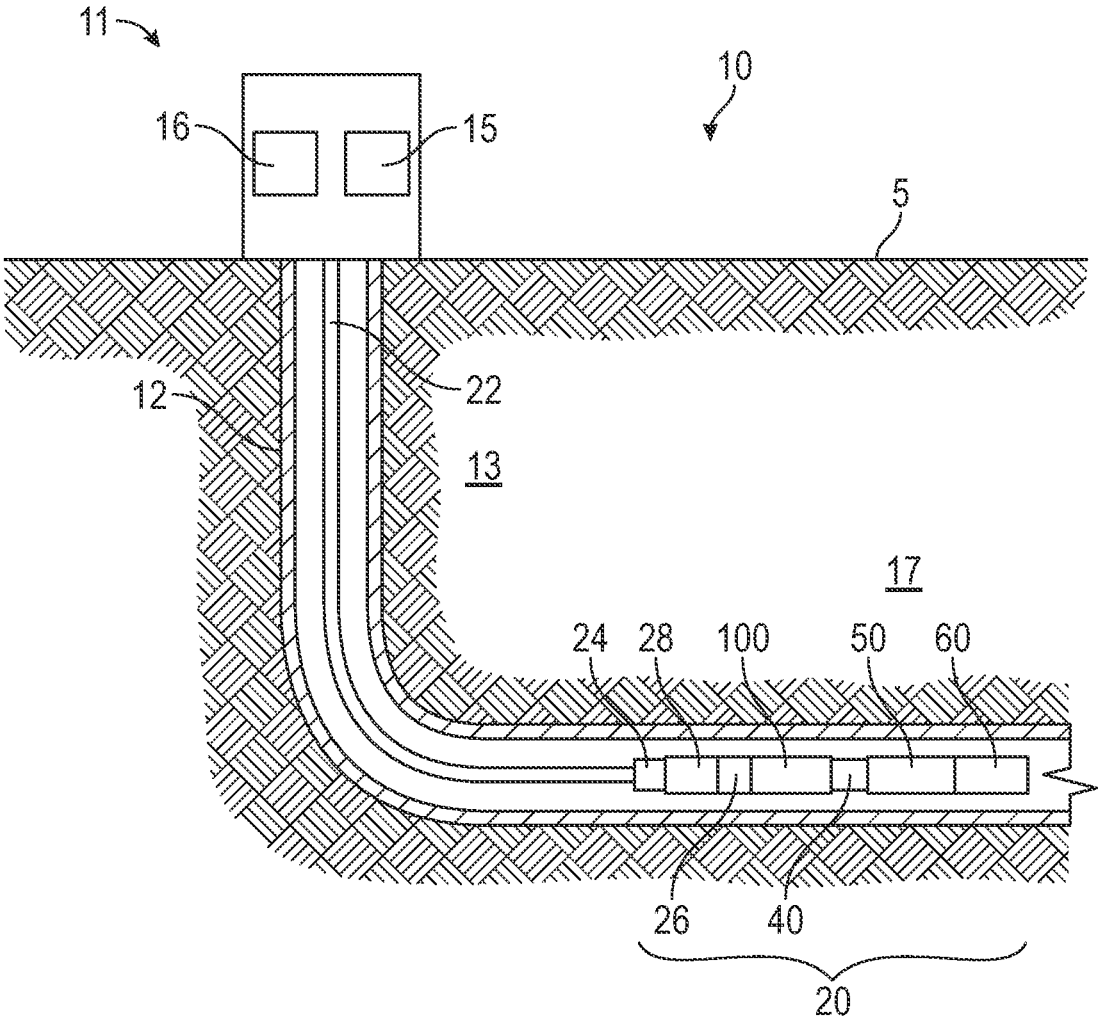
FIG. 1 is a schematic, view of an embodiment of a system for completing a subterranean well.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

As described above, in rare instances, a perforating gun of a tool string may become stuck downhole as a result of a rod-shaped electrical contact of a damaged perforating gun being partially or fully ejected from the damaged perforating gun. For example, the rod-shaped electrical contact may catch in an opening in the casing (e.g., a perf opening opened by the detonation of the perforating gun) or a joint or other irregularity along the inner surface of the casing string while also, at the same time, being caught somewhere along the tool string. As a result, the damaged perforating gun becomes stuck within the casing string, potentially requiring the wireline system from which the tool string is suspended to break off from the tool sting and gain removal of the tool string from the wellbore via expensive, specialized equipment delaying the completion of the wellbore and substantially increasing the cost for completing the wellbore.

Accordingly, embodiments of frangible electrical contacts for perforating guns are described herein which shear or otherwise yield in the event of the rod-shaped electrical contact jamming or snagging within a casing string. Particularly, the frangible electrical contact may be rod-shaped and may include one or more frangible features intended to reduce the bending strength and shear strength of the rod-shaped electrical contact. Having a reduced shear strength, the tension which may be applied to the wireline connected to the tool string by surface equipment of the wireline system may be sufficient to break apart the jammed rod-shaped electrical contact and thereby dislodge or free the tool string without having to release the wireline from the tool string. In this manner, the freed tool string may be retracted to the surface without the need for performing an expensive and time-consuming removal operation of the once stuck tool string. In some embodiments, the frangible features of the rod-shaped electrical contacts described herein take the form of frangible grooves formed in an outer surface of a frangible conductor rod of the rod-shaped electrical contact. The frangible grooves may define one or more minimum cross-sectional areas of the frangible conductor rod which deliberately weaken the conductor rod to bending and shear forces that may be applied thereto by a wireline system in the event of the frangible conductor rod becoming stuck in the wellbore.

Referring now to FIG. 1, a hydrocarbon production location or wellsite generally indicated by the arrow 10 is shown with wellbore 13 extending into a subterranean earthen formation 17 with a generally horizontal segment arranged in a target area of the earthen formation 17 that is anticipated to contain commercial quantities of hydrocarbons. Wellbore 13 is a cased wellbore including a casing string 12 secured and sealed to an inner surface or sidewall of the wellbore 13 using cement (not shown). The casing string 12 generally includes a plurality of tubular segments coupled together via a plurality of casing collars.

In this exemplary embodiment, located at the wellsite 10 is a surface assembly 11 positioned at the surface 5 with a tool string 20 deployed into a subterranean wellbore 13. Surface assembly 11 may comprise any suitable surface equipment for drilling, completing, and/or operating well 20 and may include, in some embodiments, derricks, structures, pumps, wireline reel, wireline injector, electrical/mechanical well control components, etc. In this exemplary embodiment, among other equipment, surface assembly 11 includes a control system or firing panel 15 and a surface wireline unit or winch 16, each shown schematically in FIG. 1. Tool string 20 is suspended within wellbore 13 from a flexible wireline 22 that extends from surface assembly 11 located at the surface 5. Wireline 22 generally comprises an armored cable and includes at least one electrical conductor for transmitting power and electrical signals between tool string 20 and a control system or firing panel 15 of the surface assembly 11 located at the surface 5.

Tool string 20 is generally configured to perforate the casing string 12 to provide for fluid communication between the earthen formation 17 and the wellbore 13 at one or more predetermined locations along the wellbore 13 and to thereby allow for the hydraulic fracturing of the formation 17 through the perforations formed in the casing string 12 and the subsequent production of hydrocarbons from the formation 17 into the wellbore 13 through the perforations.

In this exemplary embodiment, tool string 20 generally includes, among other components, a cable head 24 at an uphole end of the tool string 20, a casing collar locator 26, a direct connect sub 28, a perforating tool or gun 100, a setting tool initiator or firing head 40, a setting tool 50, and a downhole or frac plug 60 located at a downhole end of the tool string 20. It may be understood that in other embodiments the configuration of tool string 20 may vary from that shown in FIG. 1. For example, in other embodiments, tool string 20 may include a plurality of the perforating guns 100, one or more tandem subs connected between adjoining pairs of perforating guns 100, and/or other equipment. The one or more tandem subs may provide a pressure barrier preventing a first detonated perforating gun from inadvertently destroying or detonating a second perforating gun of the tool string 20 that is located uphole from the first detonated perforating gun. It may also be understood that tool string 20 may include other additional components not shown in FIG. 1.

In this exemplary embodiment, cable head 24 is the uppermost component of tool string 20 and includes an electrical connector for providing electrical signal and power communication between the wireline 22 and the other components of tool string 20 downhole from the cable head 24 all the way to the downhole plug 60.

Figure 2:
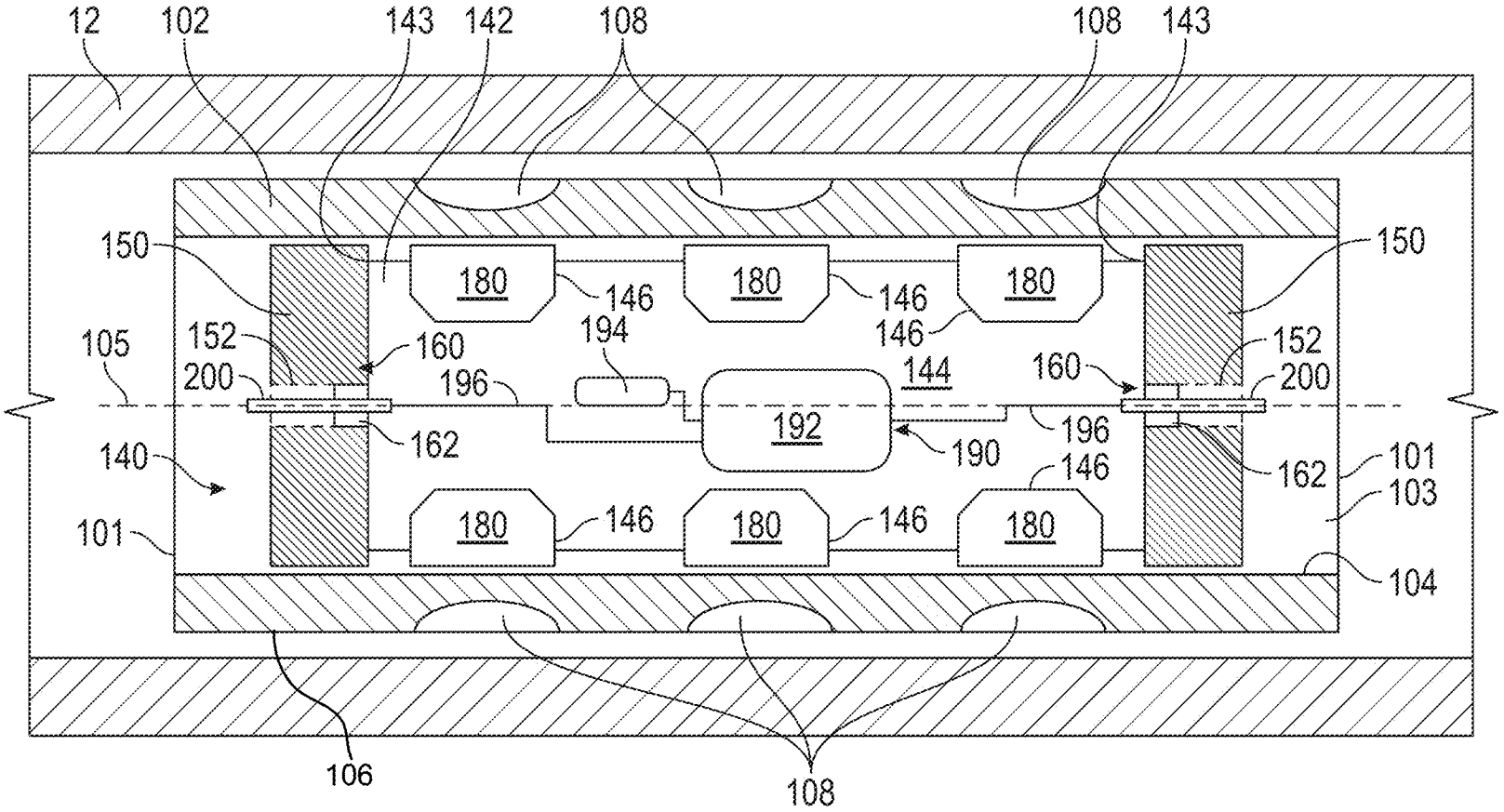
FIG. 2 is a schematic side cross-sectional view of an embodiment of a perforating gun of the system of FIG. 1.

Turning to FIG. 2, an exemplary perforating gun 100 is shown which includes one or more shaped charges 180 detonatable in response to the transmission of one or more electrical signals conveyed by the wireline 22 from the firing panel 15 at the surface 5. Upon detonation, the one or more shaped charges 180 of perforating gun 100 produce one or more corresponding explosive jets (not shown in FIG. 2) directed radially outwards and away from the perforating gun 100 and against casing string 12.

Perforating gun 100 has a central or longitudinal axis 105 and includes an outer carrier or housing 102, a charge carrier assembly 142 housed within the outer housing 102, a plurality of explosive shaped charges 180, and an initiator assembly 190 for selectably detonating the shaped charges 180. Outer housing 102 is generally tubular in shape including a pair of longitudinally opposite ends 101, a central bore or passage 103 defined by a generally cylindrical inner surface 104 extending between a pair of longitudinally opposite ends 101 of outer housing 102, and a generally cylindrical outer surface 106 also extending between ends 101. In this exemplary embodiment, a plurality of scallops or indentations 108 are formed in the outer surface 106 of outer housing 102. Each scallop 108 defines a relatively thin-walled section of outer housing 102. As will be described further herein, scallops 108 are intended to break-apart during detonation of the perforating gun 100 such that burrs are not formed along the periphery of the outer housing 102 which could catch against the casing string 12. Additionally, the break-up of scallops 108 may permit the explosive jets generated by shaped charges 180 to more easily penetrate and punch through the outer housing 102. In other embodiments, outer housing 102 may include a plurality of annular grooves or ring-like channels or indentations formed in outer surface 106 around the periphery of the housing 102 in lieu of scallops 108. The annular grooves may forego the requirement of angularly aligning the shaped charges 180 of perforating gun 100 with scallops 108. In still other embodiments, outer housing 102 may not include either scallops or annular grooves. Outer housing 102 may additionally include connectors (e.g., threaded connectors) at the ends 103 thereof for coupling with the direct connect sub 28 and firing head 40 (hidden from view in FIG. 2), respectively, of tool string 20. For example, outer housing 102 may include a pair of threaded connectors formed on the inner surface 104 thereof at ends 101. Alternatively, outer housing 102 may include a pair of threaded connectors formed on the outer surface 106 thereof at one of or both ends 101.

Charge carrier assembly 140 of perforating gun 100 is slidably received within the central passage 103 of outer housing 102. In this exemplary embodiment, charge carrier assembly 140 generally includes a generally tubular charge carrier 142 and a pair of endplates 150. Charge carrier 142 includes a pair of longitudinally opposed ends 143 and a central bore or passage 144 extending between the ends 143. Charge carrier 142 may be cylindrical in shape but alternatively could comprise a variety of shapes and configurations including configurations that are not tubular and thus not including a central passage. In this exemplary embodiment, charge carrier 142 additionally includes a plurality of radial openings 146 which each receive a corresponding shaped charge 180. Each shaped charge 180 includes a combustive or explosive material housed internally within a charge housing of the shaped charge 180. While in this exemplary embodiment perforating gun 100 includes a plurality of openings 146 and shaped charges 180, in other embodiments, perforating gun 100 may include only a single shaped charge 180 in a single corresponding radial opening 146 formed in the charge carrier 142.

Endplates 150 of charge carrier assembly 140 are coupled to the ends 143 of charge carrier 142. In this exemplary embodiment, each endplate 150 comprises a central passage 152 which houses a corresponding electrical connector 160. Electrical connectors 160 electrically connect with corresponding electrical connectors of the direct connect 28 and firing head 40, respectively, of tool string 20 to provide signal communication between charge carrier assembly 140 and the wireline 22. In this exemplary embodiment, each electrical connector 160 generally includes a biasing member or element 162 and a rod-shaped electrical contact 200 biased by the biasing element 162. The biasing element 162 of each electrical connector 160 is coupled to the rod-shaped electrical contact 200 and is configured to bias contact 200 outwardly from endplate 150 along the central axis 105 of perforating gun 100.

In this exemplary embodiment, the rod-shaped electrical contacts 200 of the pair of electrical connectors 160 each project outwardly from their respective endplates 150, thereby defining the maximum axial length of the charge carrier assembly 140. In other embodiments, each electrical connector 160 may not include biasing element 162 and instead a counterpart contact may be biased back into contact with the rod-shaped electrical contact 200. The rod-shaped electrical contacts 200 are typically received in concave (e.g., dish-shaped) receptacles of the corresponding electrical contact engaging in a male/female configuration with adjacent components of tool string 20 such as the direct connect 28 and firing head 40 to thereby form an electrical connection between perforating gun 100 and both the direct connect 28 and firing head 40. Alternatively, electrical contacts 200 may engage planar surfaces of the corresponding electrical contacts rather than concave surfaces in an end-to-end arrangement. As will be described further herein, the rod-shaped electrical contact 200 of each electrical connector 160 has a predefined, intentionally frangible configuration configured to readily yield or break apart should the contact 200 become jammed or caught between the casing string 12 following the detonation of perforating gun 100.

The initiator assembly 190 of perforating gun 100 controls the detonation of the shaped charges 180 of perforating gun 100 in response to receiving one or more electrical signals from the firing panel 15 of surface assembly 11. While initiator assembly 190 is shown within outer housing 102, in other embodiments, it may be located external housing 102 such as within an adjacently positioned tandem sub. Additionally, in this exemplary embodiment, initiator assembly 190 generally includes an electrical switch 192 and a detonator 194 electrically connected (e.g., wired, soldered, etc.) to the switch 192. Switch 192 is connected to each of the electrical connectors 160 of charge carrier assembly 140 via a pair of electrical conduits or cables 196 which extend between switch 192 and electrical connectors 160.

The electrical switch 192 of initiator assembly 190 is configured to selectably energize and thereby detonate the detonator 194 in response to receiving an appropriate firing signal from the firing panel 15. In some embodiments, electrical switch 192 may comprise one or more diodes. In other embodiments, electrical switch 192 may comprise a digital switch including one or more processors and one or more memory devices coupled to the processor and which are configured to detonate the detonator 194 in response to receiving a firing signal from the firing panel 15 which is specifically addressed to the electrical switch 192. For example, electrical switch 192 may detonate the detonator 194 in response to receiving a firing signal from the firing panel 15 at the surface 5 which includes an address which matches an associated address stored in the memory of electrical switch 192. In this exemplary embodiment, detonator 194 is ballistically coupled to each shaped charge 180 by one or more detonator or "det" cords (not shown in FIG. 2). However, in other embodiments, detonator 194 may alternatively be directly ballistically connected (without an intervening det cord) to one or more of the shaped charges 180.

Figure 3:
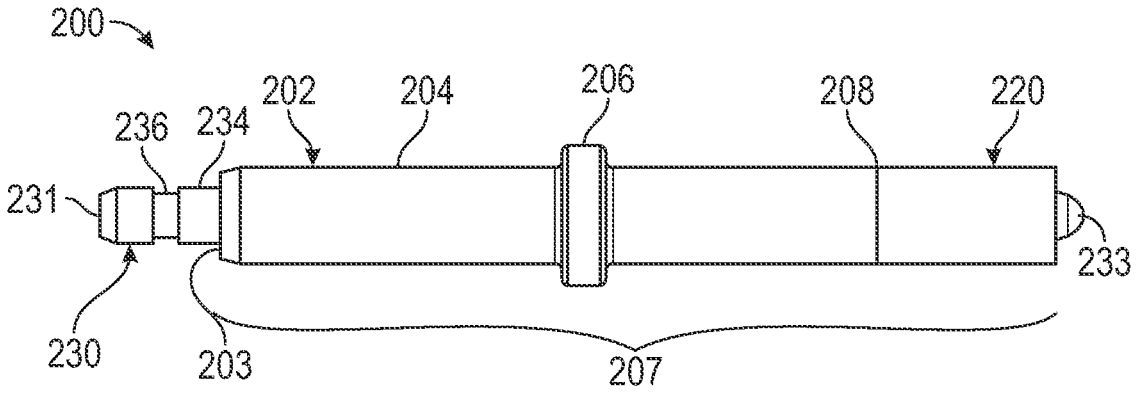
FIG. 3 is an enlarged side view of an embodiment of a rod-shaped electrical contact of the perforating gun of FIG. 2.
Figure 4:
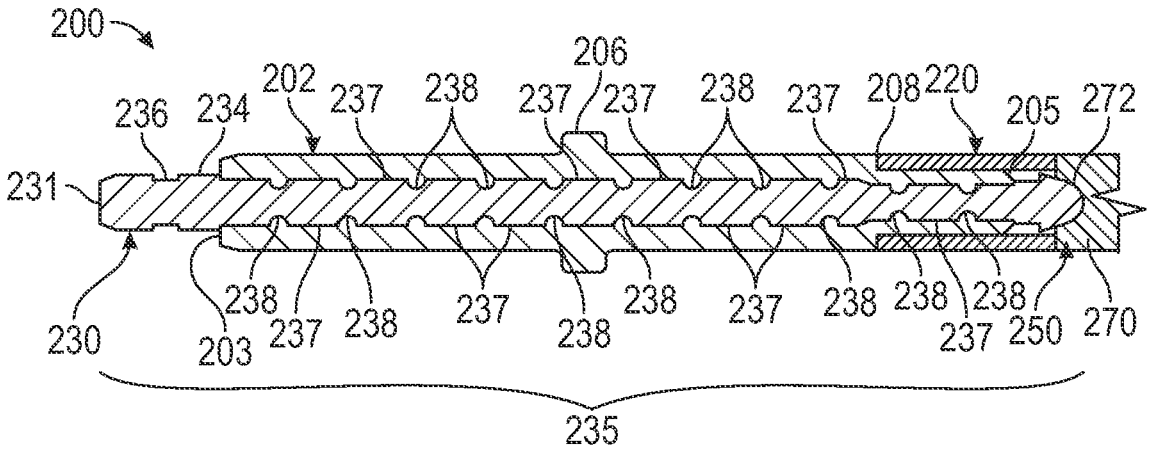
FIG. 4 is an enlarged side cross-sectional view of the rod-shaped electrical contact of FIG. 3.
Figure 5:
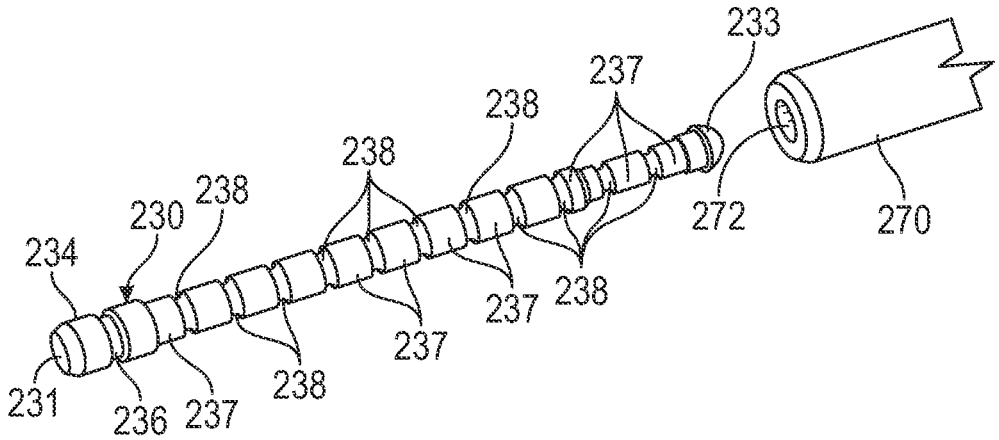
FIG. 5 is a perspective view of an embodiment of a frangible conductor rod of the rod-shaped electrical contact of FIG. 3.

Referring now to FIGS. 3-5, an embodiment of a frangible, rod-shaped electrical contact 200 of perforating gun 100 is shown. In this exemplary embodiment, rod-shaped electrical contact generally indicated by the arrow 200 includes an inner, frangible metal conductor rod 230 and an outer insulating overmolded body 202 formed on the rod 230 along with an optional, protective boot 220 slipped over one end of the rod 230. A principal design point for the electrical contact 200 is to be strong enough to serve as an electrical contact from manufacturing and assembly at the factory through the vibrations and other forces imposed while shipping the perforating gun 100 (including the electrical contact 200) to the wellsite 10, running the assembly downhole into wellbore 13, and during the detonation of the perforating gun 100, but frangible enough to yield or break if dislodged into a bending or shear orientation or arrangement. As installed in the perforating gun 100, a majority of the forces encountered by electrical contact 200 should be compressive with little or no bending force or shear force applied to the electrical contact 200. And to the extent that any substantial bending or shear force were ever to be applied to the electrical contact 200, the structure and physical integrity of the perforating gun 100 itself will likely have been compromised as well so the design of the electrical contact 200 is generally such that the contact 200 will yield and breakaway well within the forces that may be imposed on the tool string 20 while the wireline 22 is still attached.

Noting that the electrical contact 200 is comprised of two or three elements, depending on whether the boot 220 is included, the combined strength of these elements is generally what matters if the electrical connection ends up in an inconvenient place or orientation. Generally, most of the physical strength or robustness comes from the conductor rod 230. As such, the frangible design of the electrical contact 200 is most revealed in the design of the conductor rod 230. Frangible conductor rod 230 is shown as male contact in FIGS. 3-5 although the configuration at a distal end 233 of the conductor rod 230 may alternatively have a cup shape to be deemed a female connection. The frangible nature of the design of conductor rod 230 is less about the maleness or femaleness of the actual connection other than the rod 200 being elongate and thus capable of catching in the wellbore and causing a stuck tool string within the wellbore.

Additionally, the wireline 22 has a predefined yield strength, and a working strength that may be approximately between 50% and 60% of the yield strength of the wireline 22 depending on the given application. A tension applied to the wireline 22 by the wireline winch 16 of surface assembly 11 that is equal to or less than the working strength (e.g., equal to or less than 50% of the yield strength of the physical cable comprising the wireline 22) will generally not damage or permanently deform the wireline 22. In the event of the electrical contact 200 of perforating gun 100 becoming jammed or caught in casing string 12, electrical contact 200 is configured to shear or otherwise yield to free the tool string 20 in response to applying a tension to the wireline 22 by wireline winch 16 that is equal to or less than the working strength of wireline 22. It may be understood that typically the force applied to a jammed electrical contact 200 by the application of tension to wireline 22 will be a combination of bending and shear loads, and thus the shear strength of electrical contact 200 is less than the working strength of wireline 22 to ensure that the combined bending and shear loads applied to the jammed electrical contact 200 is sufficient to shear or otherwise yield the electrical contact 200 and thereby free the stuck tool string 20 such that the tool string 20 may be successfully retrieved to the surface 5 using the wireline 22. It should be understood that a maximum shear load imposable by wireline winch 16 on electrical contact 200 is greater than the designed shear strength to which the electrical contact 200 is configured to yield such that an inadvertently displaced electrical contact 200 that has become wedged or otherwise stuck against the casing string 12 after the shaped charges 180 have been fired will not prevent recovery of the tool string 20. In other words, the wireline operator will have the power required to shear through the stuck electrical contact 200 at one or more locations along the length of the electrical contact 200 and thereby continue with operations as normal rather than be forced to abandon the tool string 20 as stuck in the wellbore 13.

As an example, the wireline 22 may have a yield strength of 11,000 pound-force (lbf) and a corresponding working strength of 5,500 lbf. In some embodiments, conductor rod 230 of electrical contact 200 has a shear strength of 1,500 lbf or less, substantially less than the 5,500 lbf working strength of wireline 22. In other embodiments, conductor rod 230 has a shear strength of approximately between 1,000 lbf and 200 lbf such as, for example, 750 lbf, 500 lbf, 350 lbf, 300 lbf, and 250 lbf. It may be understood that the working and yield strengths of wireline 22 and the associated shear string of conductor rod 230 may vary substantially depending on the application.

In this exemplary embodiment, conductor rod 230 is generally long and relatively thin with a longitudinal first or inner end 231 (located at the left of FIGS. 3-5) and a second or distal end 233 longitudinally opposed (located on the right in FIGS. 3-5) to the inner end 231. The conductor rod 230 further has a generally cylindrical body with an external, peripheral surface marked principally by segments 237 separated by necked down frangible grooves or voids 238 spaced along the length of conductor rod 230. Distal end 233 of conductor rod 230 in this exemplary embodiment is arranged to be inserted into a complimentary socket 272 of electrical contact 270 to form an electrical connection therebetween. In other embodiments, instead of being received in a socket, distal end 233 of conductor rod 230 may contact a flat surface of electrical contact 270 in an end-to-end arrangement. In still other embodiments, distal end 233 of conductor rod 230 may comprise a female socket configured to receive a male end of the electrical contact 270. Frangible conductor rod 230 comprises an electrically conductive material such as brass, aluminum, copper or other suitable electrically conductive materials. Additionally, while this exemplary embodiment shows frangible conductor rod 230 as being generally cylindrical, it should be understood that the shape and configuration of conductor rod 230 may vary in other embodiments without departing from the essential purpose and function.

Insulating body 202 of rod-shaped electrical contact 200 is arranged to cover a majority of the length of the conductor rod 230 with a plastic or other durable and electrically insulating material. In this exemplary embodiment, insulating body 202 may be overmolded onto the inner contact 210 and is formed from a polymer such as, for example, a synthetic polymer (e.g., Nylon) while many other options are readily available. However, it should be understood that while outer body 202 is sufficiently durable to withstand exposure to a wellbore environment, insulating body 202 is not configured to substantially enhance the bending or shear strength provided by the conductor rod 230 of the electrical contact 200, although some marginal strengthening may be unavoidable.

Insulating body 202 generally extends along the conductor rod 230 exposing portions at each of the ends 231 and 233 thereof which externally project from the insulating body 202. In this exemplary embodiment, insulating body 202 includes a first or inner end 203, a second or outer end 205 longitudinally opposite inner end 203, and a generally cylindrical outer surface 204 having a collar section 206 located generally in the longitudinal center of insulating body 202 and that has an enlarged diameter with respect to the rest of the insulating body 202. The collar section 206 of outer surface 204 may be used in conjunction with a spring biasing system (not shown in FIGS. 3-5) to better secure the physical and electrical connection of the conductor rod 230 to the female contact 270. Additionally, insulating body 202 is formed as a tubular structure in this exemplary embodiment but it should be understood that the shape and configuration of insulating body 202 may take other forms.

The insulating body 202 of rod-shaped electrical contact 200 is generally configured to prevent or inhibit the conductor rod 230 from coming into direct electrical contact with another conductive member of perforating gun 100 such as charge carrier 142. In other words, outer body 202 reduces the likelihood of rod-shaped electrical contact 200 shorting out while the tool string 20 is in any part of its operation. In some embodiments, a ratio of the axial length 207 (shown in FIG. 3) of outer body 202 to the maximum axial length 235 (shown in FIG. 4) of conductor rod 230 is approximately between 0.5:1 to 0.9:1; however, in other embodiments, the ratio of the axial lengths of outer body 202 and frangible conductor rod 230 may vary.

In this exemplary embodiment, protective boot 220 is provided near the distal end 233 of conductor rod 230 having generally tube shape to fit over the distal end 233. As shown, the protective boot further 220 covers outer end 205 of the outer body 202 of rod-shaped electrical contact 200. Protective boot 220 is formed from an electrically insulating material but potentially a relatively more pliable material to abut the counterpart connector 270 to shield the interface between distal end 233 of conductor rod 230 and a cup 272 of the counterpart connector 270 from having dust, shavings, contaminants or other debris from interfering with or compromising the electrical conductivity therebetween. For example, protective boot 220 may be formed from a polymer such as silicone other types of pliable electrically insulating materials. Protective boot 220 may be manually slid over the outer end 205 of outer body 202 until a terminal end of boot 220 abuts shoulder 208 of outer body 202 during the initial assembly of charge carrier assembly 140 or at a wellsite prior to the deployment of the tool string 20 into the wellbore 13.

Referring still to FIGS. 3-5, in this exemplary embodiment, a retention groove 236 is formed in the outer surface 234 of frangible conductor rod 230 near the inner end 231 thereof and which is suited for connecting one of the electrical cables 196 of perforating gun 100. Additionally, in this exemplary embodiment, the plurality of annular frangible grooves 238 of conductor rod 230 are formed or cut into the outer surface 234 of frangible conductor rod 230. Although in this exemplary embodiment the frangible conductor rod 230 comprises frangible grooves 238, in other suitable embodiments, the conductor rod 230 may have different features that are typically configured to yield to shear forces or bending forces. In some embodiments, the number and configuration of frangible grooves 238 is selected, or the conductor rod 230 is otherwise configured (e.g., without any grooves but including another feature affecting the shear strength of conductor rod 230), so as to provide the conductor rod 230 with a predefined and desired shear strength which is associated with the yield and working strengths of the wireline (e.g., wireline 22) from which the perforating gun 100 (comprising rod-shaped electrical contact 200) is to be deployed from.

In this exemplary embodiment, the frangible grooves 238 are spaced along the axial length of frangible conductor rod 230 between the inner end 231 and outer end 233 thereof such that any bending resistant segment between the grooves 238 that might hang up tool string 20 is relatively short (relative to the maximum length 235 of conductor rod 230) and will less likely prove to be a long enduring catch for the tool string 20. In some embodiments, a ratio of a maximum length of a given segment 237 formed between a pair of adjacent grooves 238 to the maximum length 235 of conductor rod 230 is approximately 1:2 or less. In some embodiments, the ratio of the maximum length of a given segment 237 formed between a pair of adjacent grooves 238 to the maximum length 235 of conductor rod 230 is 1:4 or less. n certain embodiments, the ratio of the maximum length of a given segment 237 formed between a pair of adjacent grooves 238 to the maximum length 235 of conductor rod 230 is 1:6 or less. Additionally, the grooves 238 are spaced at intervals along a majority of the axial length of conductor rod 230 extending fully around the circumference of the conductor rod 230. However, rather than circumferential grooves as with this exemplary embodiment, the grooves may alternatively take the form of notches or other voids formed in the periphery of conductor rod 230 that do not extend fully around the rod 230, but still create designed yield points that can be positioned on opposing sides of conductor rod 230.

Each frangible groove 238 reduces a cross-sectional area of the frangible conductor rod 230 along the axial length of the frangible groove 238, thereby weakening the frangible conductor rod 230 in shear and in bending at the location of the frangible groove 238. Particularly, in this exemplary embodiment, one or more of the frangible grooves 238 define a minimum cross-sectional area of the frangible conductor rod 230. Given that frangible grooves 238 are spread out across the length of frangible conductor rod 230 a number of stress risers or locations of reduced shear strength are correspondingly spread at generally regular intervals on outer surface 234 along the length of frangible conductor rod 230. In some embodiments, frangible grooves 238 may be cut into the outer surface 234 of frangible conductor rod 230 during the manufacturing of rod 230. Alternatively, grooves 238 as well as conductor rod 230 itself may be formed through other processes such as through molding or additive manufacturing processes.

While in this exemplary embodiment a relatively large number of frangible grooves 238 (e.g., eleven frangible grooves 238) are formed in the outer surface 234 of frangible conductor rod 230, in other embodiments, only a small number (e.g., two or three, etc.) or a single frangible groove 238 may be formed in outer surface 234. In still other embodiments, conductor rod 230 may be of a single diameter that is small enough to shear or otherwise yield in response to the application of a tension force to the wireline 22 by wireline winch 16 that is less than a yield strength of the wireline 22. However, generally the fewer frangible grooves 238 conductor rod 20 may have the greater the axial length of each frangible grooves 238 will be to ensure the conductor rod 230 is configured to yield at an equivalent shear or bending load. In each case, the combined axial length of the one or more frangible grooves 238 formed in outer surface 234 would comprise a significant share of the total axial length of frangible conductor rod 230. For example, in some embodiments, a ratio of the combined or cumulative axial length of the one or more frangible grooves 238 to the maximum axial length 235 of conductor rod 230 ranges between 0.1:1 to 0.5:1; however, it may be understood that the ratio of the combined axial length of the one or more frangible grooves 238 and the axial length 235 of the frangible conductor rod 230 may vary in other embodiments.

As described above, the frangible grooves 238 of frangible conductor rod 230 weaken the frangible conductor rod 230 in shear and in bending. In other words, frangible grooves 238 are configured to reduce the amount of shear stress and bending force necessary to shear the rod-shaped electrical contact 200 into two separate pieces or bend the contact to allow the tool string to be withdrawn by the wireline 22. For example, applying a sufficiently great shear stress to the rod-shaped electrical contact 200 will likely result in the rod-shaped electrical contact 200 breaking apart along one of the frangible grooves 238 of frangible conductor rod 230. The presence of frangible grooves 238 therefore reduces the shear stress sufficient to result in such breaking apart of the rod-shaped electrical contact 200, which may be useful in dislodging a perforating gun 100 which has become stuck downhole. Moreover, the degree of weakening may be predefined such that the electrical contact 200 itself is configured to yield in response to a predefined tension load being applied to the wireline 22 by wireline winch 16.

Figure 6:
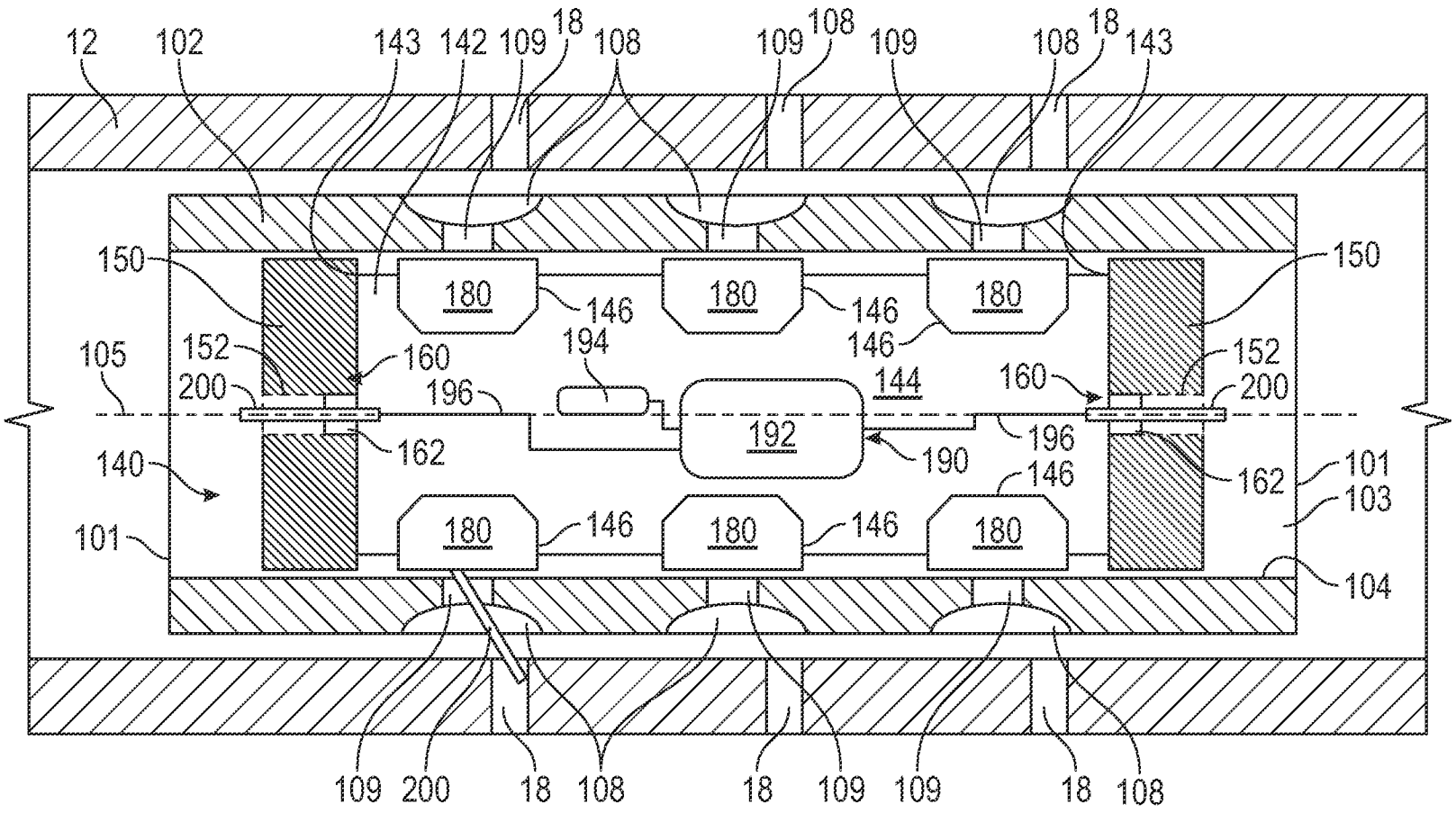
FIG. 6 is an additional enlarged side view comparable to FIG. 2 showing the perforating gun and casing after the perforating gun has been fired.

As an example, and referring now to FIG. 6, this Figure illustrates an exemplary instance in which perforating gun 100 has been detonated to form perforations 18 in casing string 12 and in which, as a result of the detonation of perforating gun 100, one of the rod-shaped electrical contacts 200 thereof has been partially ejected through an opening 109 (within one of the scallops 108) formed in the outer housing 102 of perforating gun 100 as a result of the detonation thereof. As shown in FIG. 6, a rod-shaped electrical contact without a frangible design like that of electrical contact 200 would result in the perforating gun 100 becoming undesirably locked to the casing string 12 due to the contact becoming wedged against and between the opening 109 and the slightly offset perforation 18 in the casing string 12.

Conversely, with the frangible design of electrical contact 200 shown in FIG. 6 (contact 200 is shown schematically in FIG. 6), tension applied by wireline 22 from the surface assembly 11 is sufficient to cause the electrical contact 200 to yield by bending or potentially breaking in half, resulting in the perforating gun 100 being unstuck. The force applied by the wireline cable 22 produces a shear stress between the perforating gun 100 and the casing string 12. Due to the reduced resistance to shear stress of the rod-shaped electrical contact 200 produced by frangible grooves 238, the rod-shaped electrical contact 200 shears into multiple pieces (the shearing occurring across one of the frangible grooves 238 of contact 200) or simply bends the electrical contact in response to the application of the wireline force. Additionally, electrical contact 200 may be configured to yield (e.g., bend or shear apart) in response to the application of a predefined tension force applied by the wireline 22 to the stuck perforating gun 100. The predefined tension force may be associated with a predefined shear or bending force applied by to the stuck electrical contact 200 that is sufficient to cause the electrical contact 200 to yield. For example, electrical contact 200 may be configured (through the configuration of conductor rod 230) to yield in response to a tension force applied to wireline 22 that is approximately equal to or greater than 200 lbf.

In certain embodiments, electrical contact 200 is configured to yield when only a portion of the reserve tension (e.g., less than 10% of the reserve tension, less than 25% of the reserve tension, less than 50% of the reserve tension, less than 75% of the reserve tension) imposable by wireline winch 16 is imposed on the wireline 22. The "reserve tension" imposable by the wireline winch 16 is the tension in excess of the current tension imposed by the wireline winch 16, where the current tension imposed by winch 16 may vary depending on the length of wireline 22 unspooled from the wireline winch 16 and extending from the wireline winch 16 to the tool string 20 positioned in wellbore 13. As an example, in an embodiment in which wireline winch 16 has a reserve tension, in view of the configuration of the current configuration of the wireline system and position of tool string 20 in wellbore 13, of 1,000 lbf, electrical contact 200 may be configured to yield at less than 200 lbf (20% of the reserve tension), less than 500 lbf (50% of the reserve tension), less than 750 lbf (75% of the reserve tension), etc.

Thus, as described above, by forming one or more frangible grooves 238 in the frangible conductor rod 230 of the rod-shaped electrical contact 200, the shear strength and bend resistance of the rod-shaped electrical contact 200 may be reduced by a predefined, desired amount (e.g., to a desired or predefined shear strength) which the wireline 22 and surface assembly 11 are capable of applying to the rod-shaped electrical contact 200 in the event that the contact 200 should become ejected partially from perforating gun 100 and caught against the inner surface of casing string 12.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A perforating gun deployable in a wellbore as part of a tool string, the perforating gun comprising:

an outer housing having a pair of opposed longitudinal ends and a central passage extending between the pair of longitudinal ends;

a charge carrier assembly received in the central passage of the outer housing and comprising a charge carrier having a pair of opposed longitudinal ends and at least one radially oriented receptacle configured to receive an explosive charge;

an initiator assembly including an electrical switch configured to detonate a detonator in response to receiving a firing signal; and an electrical connector positioned in the central passage of the outer housing and electrically connected to the initiator assembly, the electrical connector comprising an electrical contact including a frangible conductor rod, the frangible conductor rod having a shear strength of 1,500 pound-force (lbf) or less.

2. The perforating gun according to claim 1, wherein the shear strength of the frangible conductor rod is 750 lbf or less.

3. The perforating gun according to claim 1, wherein the shear strength of the frangible conductor rod is 300 lbf or less.

4. The perforating gun according to claim 1, wherein the electrical contact comprises an electrically insulating overmolded body surrounding the frangible conductor rod.

5. The perforating gun according to claim 4, wherein the overmolded body has an axial length which is more than half of the axial length of the frangible conductor rod.

6. The perforating gun according to claim 4, wherein the electrical connector comprises a biasing member and the overmolded body comprises an enlarged diameter annular flange contacted by the biasing member to bias the electrical contact.

7. The perforating gun according to claim 1, wherein the electrical contact further comprises a protective boot positioned around one of the longitudinal ends of the frangible conductor rod.

8. The perforating gun according to claim 1, wherein the charge carrier assembly comprises a pair of endplates each comprising a central passage and coupled to the longitudinal ends of the tubular charge carrier, wherein the electrical connector is received in the central passage of each of the endplates.

9. The perforating gun according to claim 1, wherein the frangible conductor rod comprises a pair of opposed longitudinal ends, a peripheral surface extending between the pair of longitudinal ends, and the one or more frangible features in the form of one or more frangible grooves formed in the outer surface, wherein at least one of the one or more frangible grooves defines a minimum cross-sectional area of the frangible conductor rod.

10. The perforating gun according to claim 1, wherein the frangible conductor rod comprises a pair of opposed longitudinal ends, an outer surface extending between the pair of longitudinal ends, and the one or more frangible features in the form of one or more frangible grooves formed in the outer surface and spaced along a majority of the axial length of the frangible conductor rod.

11. A perforating gun deployable in a wellbore as part of a tool string, the perforating gun comprising:

an outer housing having a pair of opposed longitudinal ends and a central passage extending between the pair of longitudinal ends;

a charge carrier assembly received in the central passage of the outer housing and comprising a charge carrier having a pair of opposed longitudinal ends and at least one radially oriented receptacle configured to receive an explosive charge;

an initiator assembly including an electrical switch configured to detonate a detonator in response to receiving a firing signal; and an electrical connector receivable in the central passage of the outer housing and electrically connected to the initiator assembly, the electrical connector comprising a frangible conductor rod comprising an elongated body with a pair of opposed longitudinal ends, a peripheral surface extending between the pair of longitudinal ends, and one or more frangible grooves formed in the peripheral surface, wherein at least one of the one or more frangible grooves defines a minimum cross-sectional area of the frangible conductor rod and a combined axial length of the one or more frangible grooves is at least 10% of the axial length of the frangible conductor rod.

12. The perforating gun according to claim 11, wherein the frangible conductor rod comprises a plurality of frangible grooves.

13. The perforating gun according to claim 11, wherein the frangible conductor rod has a shear strength of 1,500 pound-force (lbf) or less.

14. The perforating gun according to claim 11, wherein the conductor rod extends from the pair of longitudinal ends to a center of the frangible conductor rod, and at least one of the one or more frangible grooves is located on a first side of the frangible conductor rod extending from a first of the pair of longitudinal ends to the center of the frangible conductor rod, and at least one of the one or more frangible grooves is located on a second side of the frangible conductor rod extending from a second of the pair of longitudinal ends to the center of the frangible conductor rod.

15. The perforating gun according to claim 11, wherein the electrical contact comprises an electrically insulating overmolded body surrounding the frangible conductor rod.

16. The perforating gun according to claim 15, wherein the electrical connector comprises a biasing member and the overmolded body comprises an annular flange contacted by the biasing member to bias the electrical contact.

17. The perforating gun according to claim 11, wherein the electrical contact further comprises a protective boot positioned around one of the longitudinal ends of the frangible conductor rod.

18. The perforating gun according to claim 11, wherein the charge carrier assembly comprises a pair of endplates each comprising a central passage and coupled to the longitudinal ends of the tubular charge carrier, wherein the electrical connector is received in the central passage of one of the pair of endplates.

19. A perforating gun deployable in a wellbore as part of a tool string, the perforating gun comprising:

an outer housing having a pair of opposed longitudinal ends and a central passage extending between the pair of longitudinal ends;

a charge carrier assembly received in the central passage of the outer housing and comprising a charge carrier having a pair of opposed longitudinal ends and at least one radially oriented receptacle configured to receive an explosive charge;

an initiator assembly including an electrical switch configured to detonate a detonator in response to receiving a firing signal; and an electrical connector receivable in the central passage of the outer housing and electrically connected to the initiator assembly, the electrical connector comprising a frangible conductor rod comprising an elongate body, a pair of opposed longitudinal ends, a peripheral surface extending between the pair of longitudinal ends, and a plurality of frangible grooves formed in the peripheral surface and spaced along a majority of the axial length of the frangible conductor rod.

20. The perforating gun according to claim 19, wherein the conductor rod extends from the pair of longitudinal ends to a center of the frangible conductor rod, and at least one of the plurality of frangible grooves is located on a first side of the frangible conductor rod extending from a first of the pair of longitudinal ends to the center of the frangible conductor rod, and at least one of the plurality of frangible grooves is located on a second side of the frangible conductor rod extending from a second of the pair of longitudinal ends to the center of the frangible conductor rod.

21. The perforating gun according to claim 19, wherein the electrical contact comprises an electrically insulating overmolded body surrounding the frangible conductor rod.

22. The perforating gun according to claim 21, wherein the electrical connector comprises a biasing member and the overmolded body comprises an annular flange contacted by the biasing member to bias the electrical contact.

23. The perforating gun according to claim 19, wherein the electrical contact further comprises a protective boot positioned around one of the longitudinal ends of the frangible conductor rod.

24. The perforating gun according to claim 19, wherein the charge carrier assembly comprises a pair of endplates each comprising a central passage and coupled to the longitudinal ends of the tubular charge carrier, wherein the electrical connector is received in the central passage of one of the pair of endplates.

25. A method of providing a perforating gun deployable by a wireline in a wellbore as part of a tool string, the method comprising:

(a) forming an electrical connector of the perforating gun comprising an electrical contact including a frangible conductor rod whereby the frangible conductor rod is configured to yield in response to an application of a shear load to the electrical contact that is equal to or greater than a predefined shear load that is less than a shear strength of the wireline;

(b) coupling the electrical connector with an initiator assembly of the perforating gun that comprises an electrical switch;

(c) coupling the electrical connector with a charge carrier of the perforating gun having at least one radially oriented receptacle configured to receive an explosive charge detonatable by the initiator assembly when ballistically coupled to the initiator assembly; and (d) positioning the charge carrier in a central passage of an outer housing of the perforating gun.

26. The method according to claim 25, wherein (a) comprises forming one or more voids along an outer surface of a conductor rod of the electrical contact to reduce the shear strength of the electrical contact.

27. The method according to claim 25, wherein the predefined shear load is less than a maximum shear load imposable by a surface wireline unit connected to the tool string.

28. The method according to claim 27, further comprising:

(e) deploying the perforating gun down into the wellbore with the tool string attached to the wireline unit.

* * * * *